US005440885A

United States Patent [19]

Arriulou

[11] Patent Number: 5,440,885

[45] Date of Patent: Aug. 15, 1995

[54] PROCESS AND INSTALLATION FOR THE PRODUCTION OF ULTRA-PURE NITROGEN BY DISTILLATION OF AIR

[75] Inventor: Pascal Arriulou, Saint Maurice, France

[73] Assignee: L'Air Liquide, Societe Anonyme Pour L'Etude, Paris, France

[21] Appl. No.: 182,331

[22] Filed: Jan. 18, 1994

[30] Foreign Application Priority Data

Feb. 9, 1993 [FR] France ..... 93 01403

[51] Int. Cl.[6] ..... F25J 3/00

[52] U.S. Cl. ..... 62/24; 62/39

[58] Field of Search ..... 62/24, 39

[56] References Cited

U.S. PATENT DOCUMENTS 4,662,918 5/1987 Agrawal et al. ..... 62/39

5,123,947 6/1992 Agrawal ..... 62/27

FOREIGN PATENT DOCUMENTS 0384688 8/1990 European Pat. Off. .

*Primary Examiner*—Ronald C. Capossela

*Attorney, Agent, or Firm*—Young & Thompson

[57] ABSTRACT

Process and installation for the production of ultrapure nitrogen by distillation of air, wherein the air to be treated is separated in a first column (6) into nitrogen at the head and liquid at the bottom rich in oxygen. The nitrogen in the head is used to circulate in a refrigeration cycle, a flow of high pressure cycle nitrogen being purified from hydrogen in a second column (7) comprising a bottom vaporizer (11) which ensures the condensation of this nitrogen before its introduction into this second column, and a head condenser (10) cooled by the bottom liquid of the first column (6). The ultra-pure production nitrogen is withdrawn (at 24) from the bottom of the second column (7), and a second high pressure cycle nitrogen flow is condensed (in 10; 10A) by vaporization of the bottom liquid of the first column (6). At least a portion of the nitrogen condensed by vaporization of bottom liquid of the first column (6) is purified of hydrogen in the second column (7), and at least a portion of the nitrogen condensed by vaporization of bottom liquid in the first column (6) is introduced as reflux into the head of the first column (6).

9 Claims, 2 Drawing Sheets

Figure 1:
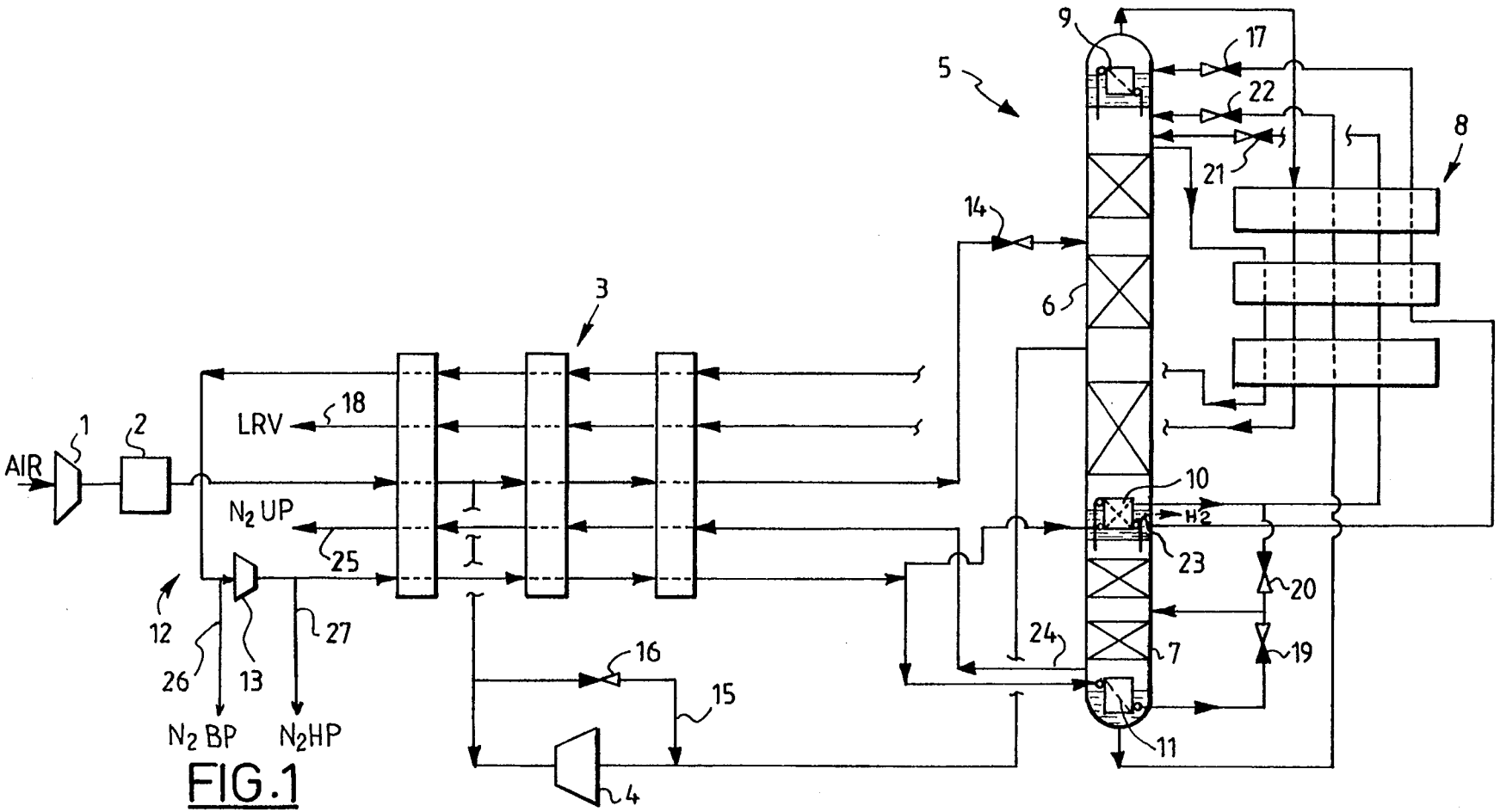

PROCESS AND INSTALLATION FOR THE PRODUCTION OF ULTRA-PURE NITROGEN BY DISTILLATION OF AIR

The present invention relates to a process for the production of ultra-pure nitrogen by distillation of air, of the type in which:

the air to be treated is separated in a first column into nitrogen in the head and into a bottom liquid rich in oxygen, head nitrogen is used to circulate in a refrigeration cycle, a flow of high pressure cycle nitrogen being purified of hydrogen in a second column comprising a bottom vaporizer which ensures the condensation of this nitrogen before its introduction into this second column, and a head condenser cooled by the bottom liquid of the first column, ultra-pure nitrogen product being withdrawn from the bottom of the second column.

Such a process, described in EP-A-413 631, has the following drawback: the condensation of the head gas of the second column being the sole means of vaporization of the bottom liquid of the first column, the reflux rates of the two columns are dependent on each other. This does not correspond to optimum conditions, because the second column effects a separation (nitrogen/hydrogen) more easily than that (oxygen/nitrogen) effected in the first column.

The invention has for its object to add a degree of freedom to the process by permitting independent adjustment of the reflux rates of the two columns, so as particularly to reduce the size of the second column, and therefore the corresponding investment.

To this end, the invention has for its object a process of the type recited above, characterized in that a second nitrogen flow of a high pressure cycle is condensed by vaporization of liquid in the bottom of the first column.

According to other characteristics:

at least a portion of the nitrogen condensed by vaporization of the liquid in the bottom of the first column is purified of hydrogen in the second column;

at least a portion of the nitrogen condensed by vaporization of the liquid in the bottom of the first column is introduced as reflux into the head of the first column.

The invention also has for its object an installation adapted to practice such a process. This installation, of the type comprising a double distillation column which itself comprises a first column for nitrogen/oxygen separation supplied by air to be treated, and a second nitrogen/hydrogen column whose head is coupled to the bottom of the first column by a vaporizer-condenser and which comprises a bottom vaporizer, and a nitrogen refrigeration cycle whose high pressure portion supplies the bottom vaporizer of the second column and then this second column itself, is characterized in that it also comprises means to condense the nitrogen of the high pressure cycle by vaporization of liquid from the bottom of the first column.

According to other characteristics of this installation:

said condensation means comprise passages for nitrogen of the high pressure cycle provided in said vaporizer-condenser;

said condensation means comprise an auxiliary vaporizer-condenser mounted in parallel with the vaporizer-condenser of the first column;

the auxiliary vaporizer-condenser is mounted outside the first column;

the installation comprises means to introduce into the second column at least a portion of the liquid nitrogen from said condensation means;

the installation comprises means to introduce as reflux at the head of the first column at least a portion of the liquid nitrogen from said condensation means.

Figure 2:
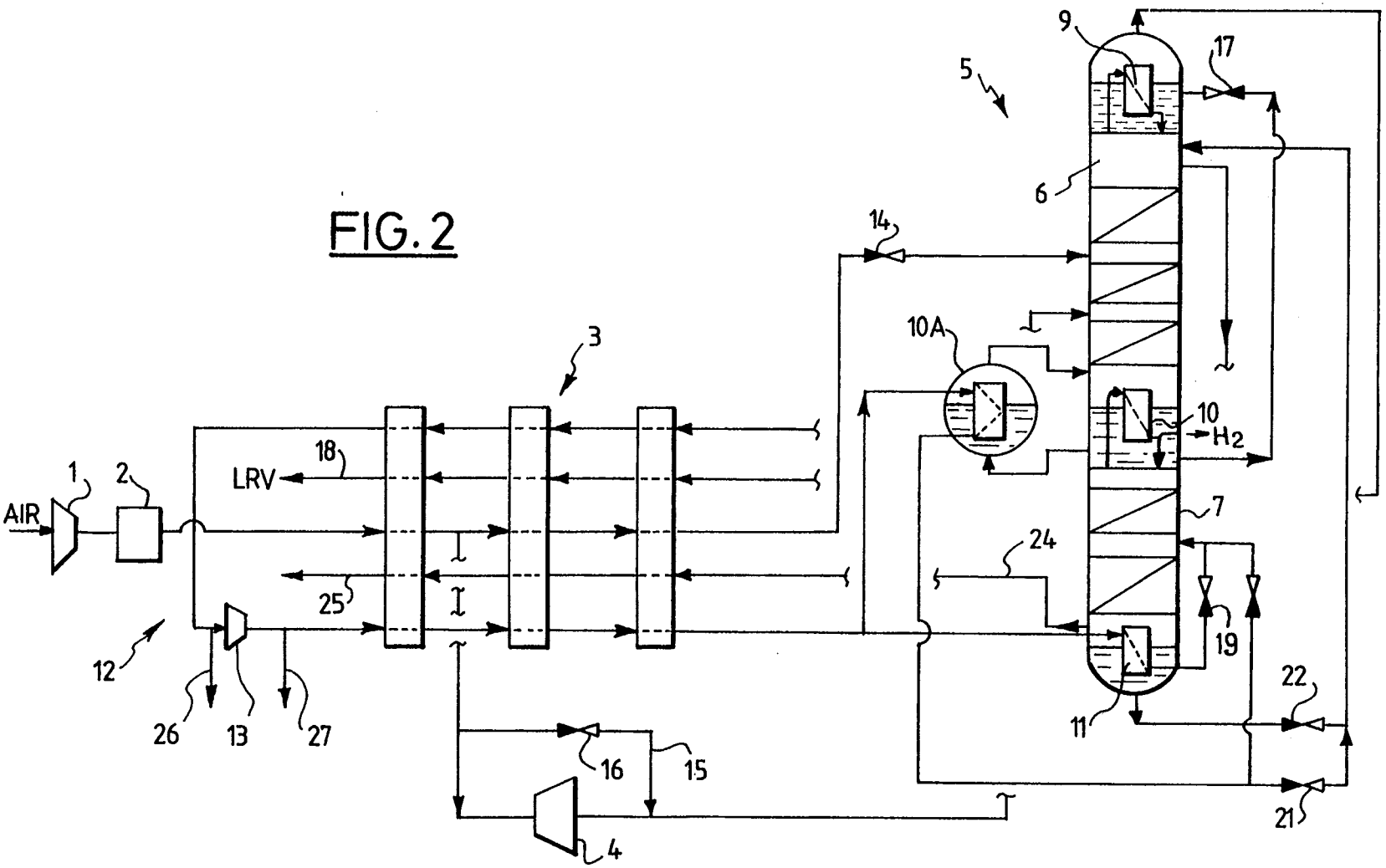

Examples of embodiments of the present invention will now be described with respect to the accompanying drawings, in which:

FIG. 1 shows schematically an installation for the production of ultra-pure nitrogen according to the invention; and FIG. 2 is an analogous view of a modification.

The installation shown in FIG. 1 comprises essentially an atmospheric air compressor 1, an apparatus 2 for purification of air from water and $CO_2$ by adsorption, a heat exchange line 3, an air expansion turbine 4, a double distillation column 5, itself constituted by a column 6 for oxygen/nitrogen separation and a column 7 for nitrogen/hydrogen separation, and a subcooler 8.

The column 6 comprises a head condenser 9 and a bottom vaporizer 10, which serves also as the head condenser for the column 7. This latter is moreover provided with a bottom vaporizer 11.

The installation also comprises a nitrogen refrigeration cycle 12, whose cycle compressor is indicated at 13.

In operation, the air to be treated, compressed in 1 and purified in 2, is cooled in 3 to an intermediate temperature T. At this temperature, only a fraction of the air is further cooled through the cold end of the exchange line and is liquefied, then is expanded in an expansion valve 14 and introduced at an intermediate level into the column 6. The rest of the air at temperature T is withdrawn from the heat exchange line, expanded in the turbine 4 and introduced at another intermediate level into the column 6. A bypass 15 about the turbine 4, provided with an expansion valve 16, permits adjusting the refrigeration thus produced.

Liquid from the bottom of column 6, rich in oxygen, is subcooled in 8, expanded in an expansion valve 17, then vaporized in 9 by condensation of nitrogen in the head of column 6. The resulting gas VRL (vaporized rich liquid)is then reheated to ambient temperature in 3 and then evacuated from the installation, as well as the residual gas, via a conduit 18.

The gaseous nitrogen produced in the head of column 6 is used as cycle nitrogen: it is partially reheated in 8, reheated to ambient temperature in 3, compressed to a high cycle pressure in 13, cooled through the cold end of the exchange line, then separated into two streams:

a first stream which is condensed in 11 by vaporization of the liquid in the bottom of column 7, expanded in an expansion valve 19 and introduced at an intermediate point of the column 7; and a second stream which is condensed in 10, in special passages of this vaporizer-condenser, by vaporization of the liquid from the bottom of column 6. The liquid thus obtained is in turn divided into a first fraction expanded in an expansion valve 20 and introduced at an intermediate point in the column 7 at the same time as the mentioned first flow, and into a second fraction expanded in an expansion valve 21 and introduced as reflux into the head of column 6.

Moreover, liquid from the bottom of column 7 is also, after subcooling in 8 and expansion in an expansion valve 22, introduced into the head of column 6.

Thus, the air is separated in the column 6 into a liquid rich in oxygen and into cycle nitrogen, and a portion of the cycle nitrogen is purified of hydrogen in the column 7. The separated hydrogen is evacuated from the vaporizer-condenser 10 via a vent 23 provided in its passages for the condensation of gas from the head of column 7.

As a result, it is the ultra-pure nitrogen, for example with a hydrogen concentration less than $10^{-9}$ (1 ppb), which is recovered from the base of the column 7, and a production flow of gaseous ultra-pure nitrogen is withdrawn from the bottom of this column via a conduit 24, reheated to ambient temperature in 3 and recovered via a production conduit 25.

The adjustment of the cycle nitrogen flow and of the flow upon opening the valves 20 and 21 permits determining independently from each other the reflux ratios of the two columns. As a result, it is possible to dimension the column 7, which effects a separation (nitrogen/hydrogen) more easily than that (oxygen/nitrogen) effected in the column 6, in an optimum manner, and thus to reduce the corresponding investment, without disturbing the operation of the principal column 6 and thus without modifying the performances of the installation.

As shown, the nitrogen of ordinary purity (for example with a hydrogen concentration of the order of ppm ($10^{-6}$)) can be recovered as product at about the pressure of the column 6 via a conduit 26 that opens just upstream of the cycle compressor 13, and/or at the high pressure of the cycle via a conduit 27 that opens just downstream of this compressor. The invention is particularly advantageous when the ultra-pure nitrogen to be produced represents only a fraction of the total nitrogen production of the installation.

The modification of FIG. 2 (in which the subcooler 8 is not shown) differs from the preceding one by the fact that the cycle nitrogen stream condensed by vaporization of the liquid at the bottom of the column 6 is condensed in an auxiliary vaporizer-condenser 10A mounted in parallel with the vaporizer-condenser 10 outside the column 6.

By way of numerical example, the following parameters can be used:

air pressure at the outlet of the compressor 1: 8 bars absolute pressure of column 6: 4 bars absolute pressure of column 7: 9 bars absolute pressure of the residual gas VRL: 1.2 bar absolute high pressure of the cycle: 11 bars absolute.

What is claimed is:

1. In a process for the production of ultra-pure nitrogen by distillation of air, comprising separating the air to be treated in a first column into nitrogen in the head of the column and liquid in the bottom of the column rich in oxygen, circulating nitrogen from the head of the column in a refrigeration cycle, purifying a flow of high pressure cycle nitrogen from hydrogen in a second column comprising a bottom vaporizer which ensures the condensation of this nitrogen before its introduction into this second column, said second column also comprising a head condenser cooled by the bottom liquid of the first column and withdrawing the ultra-pure production nitrogen from the bottom of the second column the improvement comprising condensing a second high pressure cycle nitrogen flow by vaporization of the bottom liquid of thee first column.

2. Process according to claim 1, wherein at least a portion of the nitrogen condensed by vaporization of bottom liquid of the first column is purified of hydrogen in the second column.

3. Process according to claim 1, wherein at least a portion of the nitrogen condensed by vaporization of bottom liquid in the first column is introduced as reflux into the head of the first column.

4. In an installation for the production of ultra-pure nitrogen by distillation of air, comprising a double distillation column which itself comprises a first column for nitrogen/oxygen separation supplied by the air to be treated, and a second column for nitrogen/hydrogen separation whose head is coupled to the bottom of the first column by a vaporizer-condenser and which comprises a bottom vaporizer, and a nitrogen refrigeration cycle having a high pressure portion that supplies the bottom vaporizer of the second column and then this second column itself; the improvement comprising means to condense high pressure cycle nitrogen by vaporization of liquid in the bottom of the first column.

5. Installation according to claim 4, wherein said condensation means comprise passages for nitrogen of the high pressure cycle provided in said vaporizer-condenser.

6. Installation according to claim 4, wherein said condensation means comprise an auxiliary vaporizer-condenser (10) mounted in parallel with the vaporizer-condenser (10) of the first column.

7. Installation according to claim 6, wherein the auxiliary vaporizer-condenser is mounted outside the first column.

8. Installation according to claim 4, which further comprises means to introduce into the second column at least a portion of the liquid nitrogen from said condensation means.

9. Installation according to claim 4, which further comprises means to introduce as reflux into the head of the first column at least a portion of the liquid nitrogen from said condensation means.

* * * * *